US005429516A

United States Patent [19]

d'Alayer de Costemore d'Arc

[11] Patent Number: 5,429,516

[45] Date of Patent: Jul. 4, 1995

[54] ELECTRICAL PLUG-SOCKET ADAPTOR WITH DISCONNECT MECHANISM

[75] Inventor: Stephane M. A. d'Alayer de Costemore d'Arc, Genappe, Belgium

[73] Assignee: Staar S.A., Brussels, Belgium

[21] Appl. No.: 238,669

[22] Filed: May 5, 1994

[51] Int. Cl.[6] ..... H01R 13/62

[52] U.S. Cl. ..... 439/159; 439/153; 439/651

[58] Field of Search ..... 439/638-655, 439/696, 701, 217, 218, 352, 152-160, 180

[56] References Cited

U.S. PATENT DOCUMENTS

| | | | |
|---|---|---|---|
| 2,551,382 | 5/1951 | Lindsay | 439/159 |
| 3,083,274 | 3/1963 | Sparkes | 439/153 |
| 3,843,853 | 10/1974 | Panek et al. | 439/153 |
| 4,941,846 | 7/1990 | Guimond et al. | 439/180 |
| 5,171,291 | 12/1992 | d'Alayer de Costemore d'Arc et al. | . |
| 5,211,569 | 5/1993 | Havens | 439/159 |

*Primary Examiner*—David L. Pirlot
*Attorney, Agent, or Firm*—Leydig, Voit & Mayer

[57] ABSTRACT

A plug assembly which can be inserted in the socket of a standard receptacle, the adaptor providing a socket into which a terminal plug on the end of a cord may be inserted, and the disconnect mechanism of the adaptor having an actuator which is rotatable by a user with small effort to eject the terminal plug from the adaptor leaving the adaptor inserted in the receptacle. A second embodiment of adaptor according to the invention is applied to a socket assembly which can be mated on the plug of a terminal fitting of the end of a cord or cable, the adaptor providing a plug which may be inserted into a the socket of a standard receptacle, and the disconnect mechanism of the adaptor having an actuator which is rotatable by a user with small effort to eject the adaptor-plug from the receptacle-socket leaving the adaptor connected to the terminal plug on the end of the cord.

10 Claims, 2 Drawing Sheets

ELECTRICAL PLUG-SOCKET ADAPTOR WITH DISCONNECT MECHANISM

This invention relates to improvements to mechanisms for disconnecting electrical plugs more easily from electrical sockets with which they have been mated.

BACKGROUND

In applicant's U.S. Pat. No. 5,171,291, embodiments are disclosed of removing mechanisms applied to both electrical plugs and sockets. In both applications an actuating member preferably rotatably mounted to a body carrying the electrical contact elements of either the plug or socket is manually actuable to operate a cam and move a thrust member into engagement with a mating assembly to separate the mating contact elements.

In Applicant's copending application Ser. No. 08/238,668 entitled "Automatic Disconnect Mechanism for Electrical Terminal Fittings", a removing or disconnect mechanism is applied to a terminal electrical fitting on a cord or cable, which terminal fitting may be a plug or a socket, the removing mechanism being operable responsive to a pull on the cord to actuate the removing mechanism to disconnect the terminal fitting on the end of the cord from a mating electrical fitting.

SUMMARY OF THE INVENTION

Prior mechanisms for disconnecting mating electrical fittings, such as those disclosed in applicants prior patent and application referenced above, are incorporated in terminal fittings connected to a cord or incorporated in electrical receptacles constructed to be permanently installed in building walls.

The main object of this invention is to provide a unitary electrical adaptor with a disconnect mechanism, which adaptor makes it possible to obtain many features of applicants prior disconnect mechanisms merely by plugging the adaptor into a receptacle or mating it to a cord-connected plug.

A first embodiment of adaptor according to the invention is applied to a plug assembly which can be inserted in the socket of a standard receptacle, the adaptor providing a socket into which a terminal plug on the end of a cord may be inserted, and the disconnect mechanism of the adaptor having an actuator which is rotatable by a user with small effort to eject the terminal plug from the adaptor leaving the adaptor inserted in the receptacle.

A second embodiment of adaptor according to the invention is applied to a socket assembly which can be mated to the plug of a terminal fitting on the end of a cord or cable, the adaptor providing a plug which may be inserted into the socket of a standard receptacle, and the disconnect mechanism of the adaptor having an actuator which is rotatable by a user with small effort to eject the adaptor-plug from the receptacle-socket leaving the adaptor connected to the terminal plug on the end of the cord.

Further features and objects of the invention will appear from the following description taken in conjunction with the accompanying drawings, in which:

DETAILED DESCRIPTION OF THE BEST MODES

Figure 1:
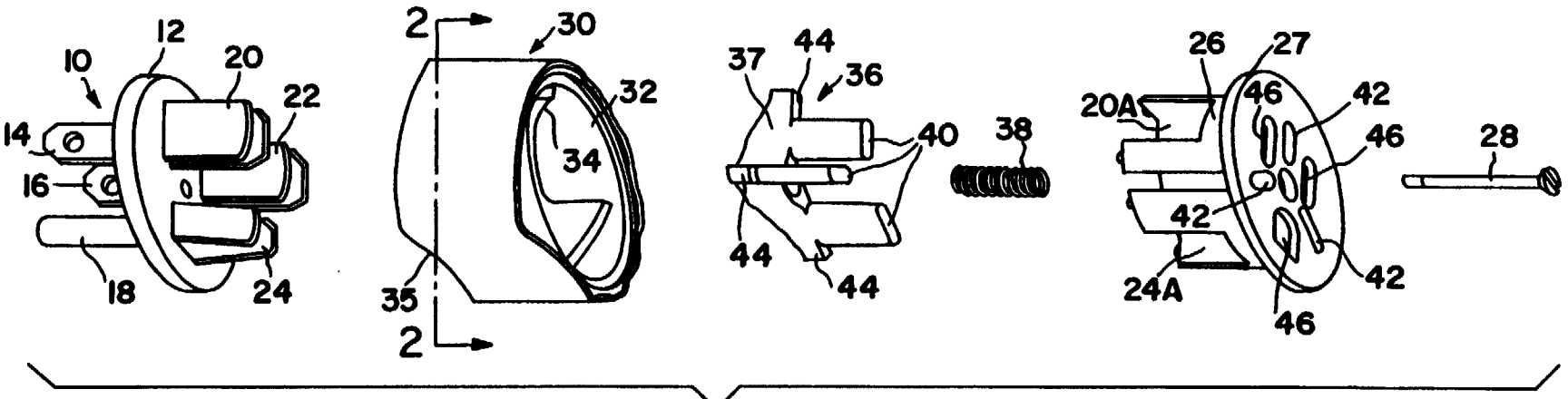
FIG. 1 is an exploded perspective view of the first adaptor embodiment of the invention.
Figure 5:
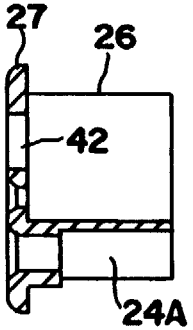
FIG. 5 is a sectional view of the adaptor body taken substantially in the plane of 5—5.
Figure 4:
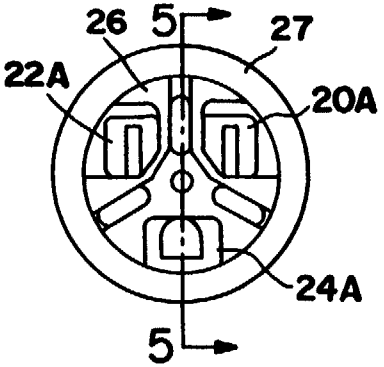
FIG. 4 is an end view (from the left in FIG. 1) of the adaptor body shown in FIG. 1.
Figure 3:
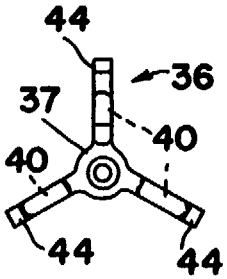
FIG. 3 is an end view (from the left in FIG. 1) of the ejector shown in FIG. 1.
Figure 2:
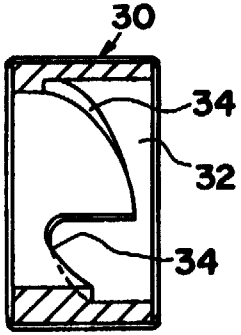
FIG. 2 is a sectional view of the actuator shown in FIG. 1 taken substantially in the plane of 2—2.

Referring to FIGS. 1-5 of the drawings, the first embodiment of adaptor according to the invention has a standard plug assembly 10 including a plug support member 12 carrying on its front face prongs 14,16 and a ground pin 18 which are insertable into the contact clips of a socket of a standard wall-mounted receptacle (not shown). The plug support member 12 behind the front face also carries socket contact clips 20,22,24 which are electrically connected through the plug support member 12 to the prongs 14,16 and ground pin 18 respectively. The contact clips 20,22,24 nest in cavities 20A, 22A, 24A (FIGS. 4, 5), in an adaptor body 26 which is between the plug support member 12 and a socket member 27 which is fastened to the plug support member 12 by a small diameter nut/bolt fastener 28 on the axis of the assembled parts. As herein shown, the socket member 27 and the adaptor body 26 are preferably a unitary molded part of plastic such as nylon or other abrasion resistant high strength material having good electrical insulating properties. The plug support member 12 is preferably a molded plastic disc. Rotatably mounted to the adaptor body 26 is an annular actuator 30 having on its cylindrical inside circumferential surface 32 a plurality (herein shown as three) of helical cams 34 provided by raised edges each comprising 120 degrees of the inside circumference of the actuator 30. The outside circumference of the actuator 30 is irregularly shaped 35 to allow a user to grip it and turn it more readily.

In carrying out the invention, also nesting within cavities in the body 26, is an ejector 36 (FIG. 3) which is axially movable and biased toward a retracted position (toward the left in FIG. 1) by a return spring 38. The ejector 36 is preferably a molded plastic part having a spider 37 which carries a plurality of elongated thrust elements 40 (three are shown) which are equally offset radially from the central axis of the adaptor; the elongated thrust elements 40 slide axially in respective cavities in the body 26 and project through openings 42 in the socket member 27 in an ejection stroke to reach an ejecting position and are retracted within the body 26 to the retracted position of the ejector 36. To move the ejector 36 and thrust elements 40 axially the cams 34 coact with followers herein shown as radially extending pins 44 on the outer edges of the thrust elements 40 where they join the spider 37 of the ejector 36; to move the thrust elements axially to project through the openings 42 the actuator 30 is rotated manually in one direction and the ejector 36 is moved axially by the coacting cams 34 and pins 44; to retract the thrust members 40 after release of the actuator 30 the return spring 38 acts to retract the ejector 36 axially and via the coacting pins 44 and cams 34 rotates the actuator 30 in the opposite direction to its original rest position.

In addition to the openings 42 for the thrust elements 40 to pass through the socket member 27, openings 46 are provided therein for access to the contact clips 20,22,24 by prongs of a plug. The openings 46 are aligned with the cavities 20A, 22A, 24A, in the adaptor body 26 in which the contact clips 20, 22, 24 are received when the adaptor is assembled.

Thus, with the adaptor prongs 14,16 and ground pin 18 inserted into the socket openings of a standnrd wall-mounted receptacle, the contact clips 20,22 will be energized and the ground clip 24 will be connected to ground providing an electrically energized adaptor socket ready to receive the prongs and ground pin of a plug on the end of a cord connected to an appliance, for example, or any other device requiring electrical power. After such a plug is inserted into the adaptor socket member 27, it may easily be disconnected from the adaptor socket member 27 by manually rotating the actuator 30 which, through the cams 34, will move the ejector 36 axially and the thrust elements 40 thereof through the openings 42 into engagement with the facing surface of the inserted plug. The rotational force exerted manually on the actuator 30 is translated by the motion converting mechanism provided by the cams 34 and coacting followers into force applied axially to the plug by the thrust elements 40 to eject the plug from the adaptor socket. The helical angle of the cams 34 is preferably such as to provide a mechanical advantage averaging about 3:1 to multiply the manual force applied to eject the plug, and to allow a plug to be ejected easily with minimum manual effort. Preferably the cams 40 have a varying angle to provide maximum ejecting force at the beginning of the ejection stroke of the thrust elements 40 to overcome the gripping force exerted by the contact clips 20,22,24 on the prongs and ground pin of the inserted plug, and less force at the end of the ejection stroke to produce a soft ejection. Once the plug has been fully ejected from the adaptor socket member 27, the actuator 30 may be released and the return spring 38 will retract the thrust elements 40 to ready the adaptor to receive another plug inserted into its socket member 27.

Figure 6:
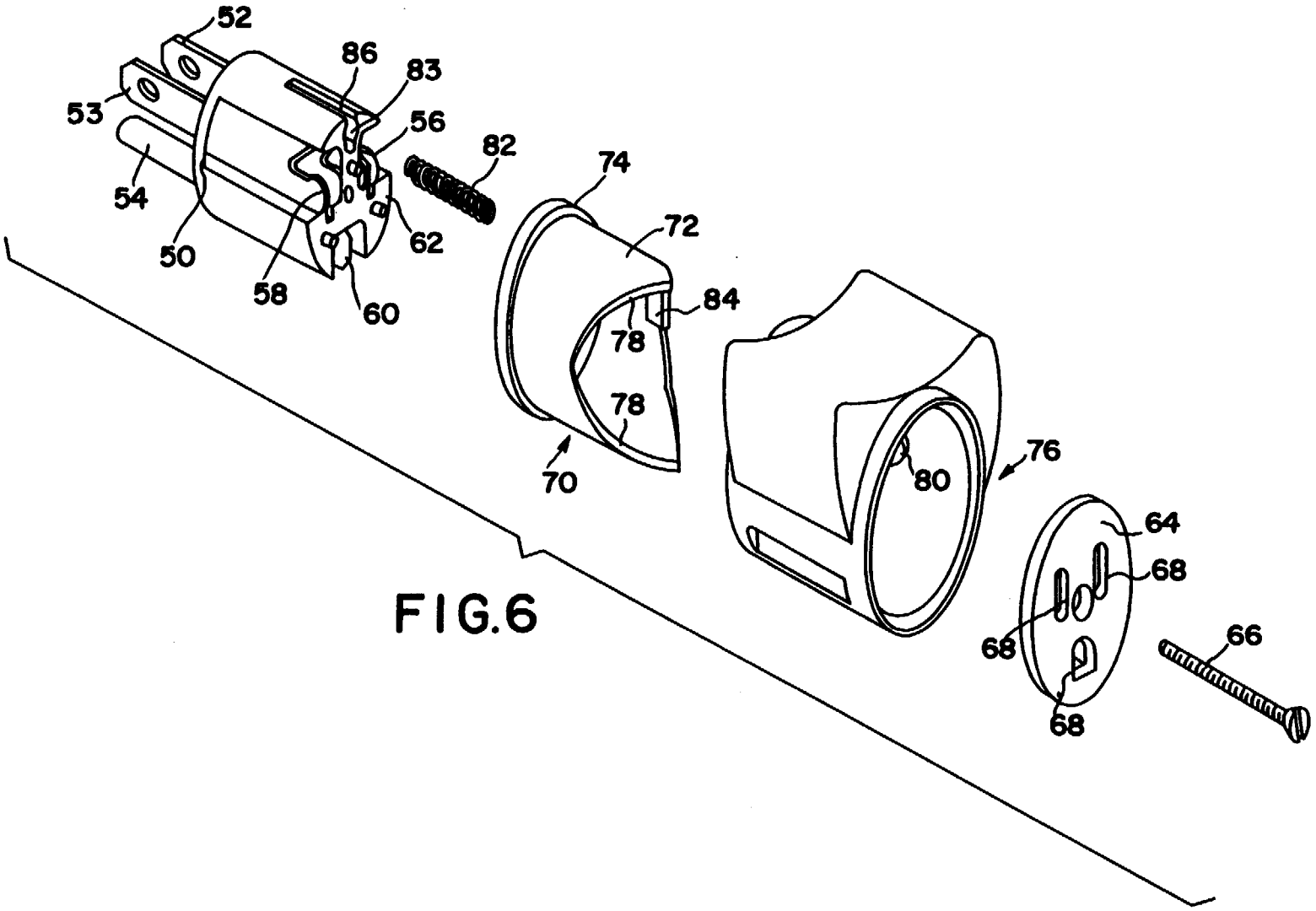
FIG. 6 is an exploded perspective view of the second adaptor embodiment of the invention.

Now turning to FIG. 6, a second embodiment is shown of adaptor provided with disconnect mechanism according to this invention. In this embodiment the adaptor is constructed to be mated to a plug connected on the end of a cord so as, in effect, to equip the plug with a disconnect mechanism without it being an integral component. A plug so equipped may then be easily removed by means of the disconnect mechanism from one receptacle in which it has been inserted and carried on the end of its cord to another receptacle and inserted therein while the adaptor remains mated to the plug. As an example, the adaptor of this second embodiment may be placed on the plug on the end of a vacuum cleaner cord. The plug prongs provided by the adaptor may be inserted in the socket of a wall receptacle in the normal fashion and the vacuum cleaner operated with power supplied through the cord; when the operator desires to move to another location to operate the vacuum cleaner, as is customary and expected, the adaptor plug may easily be removed from the wall socket at the first location and moved to a wall socket at another location. One of the problems which is experienced with the operation of vacuum cleaners arises because the vacuum cleaner cords are usually provided with heavy duty plugs and the regular removal of such plugs from wall sockets frequently causes damage to the sockets or their mounting to wall studs or brackets because of the relatively large pulling force required to remove the plugs manually. With the assistance of the disconnect mechanism provided by this embodiment of adaptor on the end of the vacuum cleaner cord, the adaptor plug can be removed from a wall socket without pulling on the socket, minimizing the risk of damage to the socket.

To this end, a plug support member 50 carries prongs 52,53 and a ground pin 54 on its front face and contact clips 56,58,60 behind its front face in cavities of an adaptor body 62 herein shown as a unitary molded part with the plug support member 50. The contact clips 56,58,60 are electrically connected to the prongs 52,53 and ground pin 54 respectively so as to be electrically energized when the prongs are plugged into the socket of a receptacle.

A socket member 64 is fastened to the plug support member 50 and the adaptor body 62 by a bolt/nut fastener 66 located on the axis of the assembled parts. The socket member 64 has openings 68 providing access to the contact clips 56,58,60 for prongs and ground pin of a plug (not shown) and for this purpose are axially aligned therewith.

In keeping with the invention, to provide a disconnect mechanism, a thrust element 70 is mounted for axial movement relative to the adaptor body 62 and in this case comprises an annular thrust element 70 having a thin main section 72 around the body 62 and a thicker flange portion 74 at the front of the thrust element which is located in a retracted position of the thrust element at the front face of the plug support member 50. To move the thrust element 70 axially between the retracted position and an ejecting position projecting forward from the front face of the plug support member 50, an annular actuator 76 is rotationally mounted for rotation about the main section 72 of the thrust element 70 and is concentric therewith and with the body 62. Helical cams 78 are formed in the back edge of the main section 72 of the thrust element 70 which coact with followers herein shown as pins 80 projecting inward from the inner circumferential surface of the annular actuator 76 to engage the surfaces of the cams 78 and move the thrust element 70 in a forward ejecting stroke (to the left in FIG. 6) when the actuator 76 is rotated manually in either direction from a rest position. A return spring 82 received in a cavity 83 in the adaptor body 62 and engaging a lug 84 on the thrust element 70 exerts an axial force to return the thrust element 70 to its retracted position when the actuator 76 is released, and through the coacting cams 78 and pins 80 returns the actuator 76 to its rest position. The lug 84 extends through the slot 86 into engagement with the spring 82, and the slot 86 prevents rotation of the thrust element 70. In this embodiment, the actuator 76 can be rotated in either direction (i.e., it has reversible movement); in the embodiment of FIGS. 1-5 the actuator 30 is movable in a single direction. As in the first embodiment, the cams 78 preferably have a varying helical angle to provide a high initial ejecting force and a soft final ejection.

In both embodiments all the component parts (except the current conducting parts and fasteners) may be molded plastic parts providing an adaptor which may be easily assembled from its component parts and manufactured at low cost.

I claim:

1. An adaptor including an electrical plug-socket disconnect mechanism, the adaptor comprising:

a plug member having a front face;

prongs carried on the front face of the plug member which are insertable into socket openings of a mating electrical fitting;

socket contact clips carried behind the front face of the plug member which are electrically connected through the plug member to the prongs;

a socket member behind the socket contact clips which is fastened to the plug member and includes openings axially aligned with the socket contact clips to allow access thereto through the socket member by prongs of a mating electrical fitting;

an adaptor body between the plug member and the socket member in which the socket contact clips are received;

an axially movable elongated thrust element mounted to the adaptor body for axial movement between a retracted position and an ejecting position projecting axially from one of the members; and an actuator and mechanism mounted to the adaptor body which responsive to manual operation of the actuator applies force moving the elongated thrust element axially from the retracted position toward the ejecting position and into engagement with a mating electrical fitting to disconnect it and the adaptor.

2. An adaptor according to claim 1 wherein the one of the members is the socket member, the elongated thrust element is received and is movable axially in the adaptor body, and the socket member also has an opening axially aligned with the thrust element which allows movement of the elongated thrust element from a retracted position to an ejecting position projecting from the socket member, to disconnect a mating electrical fitting plug from the adaptor.

3. An adaptor according to claim 1 wherein the one of the members is the plug member, the adaptor body is substantially cylindrical, and the elongated thrust element is an annular element axially slideable on a main circumferential portion of the adaptor body from a retracted position to an ejecting position projecting from the plug member, to disconnect the adaptor from a mating electrical fitting socket.

4. An adaptor according to claim 1 wherein the actuator and mechanism mounted to the adaptor body includes an annular actuator mounted for rotational movement about the adaptor body, and a motion converting mechanism providing a mechanical advantage connected between the annular actuator and the elongated thrust element whereby rotation of the annular actuator by a manual force applies a greater force moving the elongated thrust element axially from the retracted position toward the ejecting position and into engagement with a mating electrical fitting to disconnect it and the adaptor.

5. An adaptor according to claim 4 including a return spring acting on the elongated thrust element and actuator to return them to a rest position after rotation of the annular actuator by a manual force to disconnect a mating electrical fitting and the adaptor.

6. An adaptor according to claim 4 wherein the motion converting mechanism includes coacting cams and followers connected between the annular actuator and the elongated thrust element, and wherein the cams have a varying angle providing a greater mechanical advantage and maximum ejecting force during a beginning portion of an ejection stroke of the elongated thrust element, and less force at an end portion of the ejection stroke to produce a soft ejection.

7. An adaptor including an electrical plug-socket disconnect mechanism, the adaptor comprising:

a plug member having a front face;

prongs carried on the front face of the plug member which are insertable into socket openings of a mating electrical fitting;

socket contact clips carried behind the front face of the plug member which are electrically connected through the plug member to the prongs;

a socket member behind the socket contact clips which is fastened to the plug member and includes openings axially aligned with the socket contact clips to allow access thereto through the socket member by prongs of a mating electrical fitting;

a substantially cylindrical adaptor body carried by the plug member and formed therewith as a unitary molded part and having cavities in which the socket contact clips are received;

an elongated annular thrust element axially slidable on a circumferential portion of the adaptor body between a retracted position and an ejecting position projecting axially from the front face of the plug member;

an annular actuator concentric with and mounted for rotational movement on the thrust element;

a motion converting mechanism providing a mechanical advantage connected between the actuator and the thrust element including coacting cams and followers which, responsive to rotation of the actuator by manual force, applies a greater force moving the thrust element axially from the retracted position toward the ejecting position and into engagement with a socket of a mating electrical fitting to disconnect it and the adaptor; and a return spring acting on the thrust element and actuator to return the thrust element to the retracted and the actuator to a rest position after rotation of the actuator from the rest position by manual force.

8. An adaptor according to claim 7 wherein the cams of the motion converting mechanism have a varying angle providing a greater mechanical advantage and maximum ejecting force during a beginning portion of an ejection stroke of the thrust element, and less force at an end portion of the ejection stroke to produce a soft ejection.

9. An adaptor including an electrical plug-socket disconnect mechanism, the adaptor comprising:

a plug member having a front face;

prongs carried on the front face of the plug member which are insertable into an electrical fitting socket;

socket contact clips carried by the plug member behind its front face which are electrically connected through the plug member to the prongs;

a substantially cylindrical adaptor body carried behind the plug member provided with cavities in which the socket clips are received;

a socket member carried behind the adaptor body formed as a unitary molded part therewith and having openings axially aligned with the socket contact clips cavities to allow access through the socket member by prongs of an electrical fitting plug to the socket contact clips;

an axially movable thrust element including a central spider carrying a plurality of radially offset elongated thrust elements mounted for axial movement in cavities of the adaptor body, the elongated thrust elements being movable from a retracted position through openings in the socket member to an ejecting position projecting therefrom;

an annular actuator mounted for rotational movement about an outer circumferential portion of the adaptor body;

a motion converting connection including cams on an inner circumferential portion of the annular actuator and followers radially extending from the elongated thrust elements whereby rotation of the actuator by manual force from a rest position produces force moving the spider and thrust elements axially from the retracted to the ejecting position and into engagement with a mating electrical plug, which has prongs extending through the socket member into the socket contact clips, to disconnect it from the adaptor; and a return spring acting on the thrust elements to return them to the retracted position and the actuator to return it to the rest position after rotation of the actuator by manual force from the rest position.

10. An adaptor according to claim 9 wherein the cams of the motion converting mechanism have a varying angle providing a greater mechanical advantage and maximum ejecting force during a beginning portion of an ejection stroke of the thrust elements, and less force at an end portion of the ejection stroke to produce a soft ejection.

* * * * *